US005148981A

United States Patent [19]

Lynch, Jr. et al.

[11] Patent Number: 5,148,981

[45] Date of Patent: Sep. 22, 1992

[54] TRACK CIRCUIT RETAINER CLIP

[75] Inventors: Edward J. Lynch, Jr., Akron; Raymond S. Laughlin, Cuyahoga Falls, both of Ohio

[73] Assignee: Erico International Corporation, Cleveland, Ohio

[21] Appl. No.: 354,390

[22] Filed: May 19, 1989

[51] Int. Cl.[5] ..... E01B 89/62

[52] U.S. Cl. ..... 238/351; 238/14.14; 238/349; 248/72

[58] Field of Search ..... 238/14.14, 310, 351, 238/378, 349, 323; 191/23 A; 248/74.1, 74.2, 72; 174/40 CC

[56] References Cited

U.S. PATENT DOCUMENTS

| | | | |
|---|---|---|---|
| 2,332,855 | 6/1942 | Jones . | |
| 2,657,442 | 4/1953 | Bedford, Jr. | 248/72 X |
| 3,037,729 | 6/1962 | Holton | 174/40 CC |
| 3,059,884 | 10/1962 | Stanfill | 238/14.14 X |
| 4,527,759 | 7/1985 | Dorner et al. | 248/74.2 |
| 4,826,078 | 2/1989 | Arvin et al. | 238/351 X |

FOREIGN PATENT DOCUMENTS

| | | | |
|---|---|---|---|
| 552628 | 4/1943 | United Kingdom | 174/40.1 |

*Primary Examiner*—Joseph F. Peters, Jr.
*Assistant Examiner*—Virna Lissi Mojica
*Attorney, Agent, or Firm*—Renner, Otto, Boisselle & Sklar

[57] ABSTRACT

A track circuit retainer clip adapted to be driven on the edge of the base of a rail holds one or a plurality of conductors parallel to and within the rail base edge. The clip comprises a U-shape spring metal clip having a bight portion and upper and lower legs which embrace the rail base edge. The upper leg includes a center spring finger extending from the bight portion which includes two concave side-by-side recesses to hold the conductors against the upper leg. The outer end of the spring finger flares upwardly to facilitate insertion and the lateral edges of the spring finger are bent upwardly to avoid biting into the conductors. The lower leg includes barbs struck from the edge which terminate in truncated biting edges extending substantially parallel to the rail base edge. The line contact transverse the direction of insertion provides ease of insertion and better gripping or holding action without scratching or notching the bottom of the rail.

9 Claims, 1 Drawing Sheet

TRACK CIRCUIT RETAINER CLIP

BACKGROUND OF THE INVENTION

Track circuits for railroad tracks require electrical cables or wires connected to the rails such as rail bonds. These cables or wires often must extend along the rails from one location to another. If they are loose or extend beyond the rail base edge they may become entangled or be pulled loose. They may also get in the way of track maintenance or resurfacing machinery which straddles the rails. Accordingly there is a need for an easily installed clip in which wires or cables may readily be inserted and which maintain such wires or cables neatly parallel to and within the rail base edge. The clip should also firmly grip the rail without damaging the rail when inserted.

SUMMARY OF THE INVENTION

A track circuit retainer clip for running rail adapted to secure one or two conductors extending parallel to the rail and within the edge of the base of the rail. The clip includes a U-shape spring metal body having a bight portion and upper and lower legs to embrace the rail base edge. An upwardly extending spring finger extends from the bight portion between two lateral portions of the upper leg, which finger includes two side-by-side concave recesses adapted to embrace side-by-side conductors and hold the same firmly against the lateral portions of the upper leg. The lateral edges of the finger flare upwardly and the tip also extends upwardly to facilitate insertion of the conductors without damage. The lower leg includes edges tangs or barbs having truncated biting edges which bite into the bottom of the rail base to provide a biting line contact extending parallel to the rail. The distal edge of the lower leg flares downwardly to facilitate installation.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
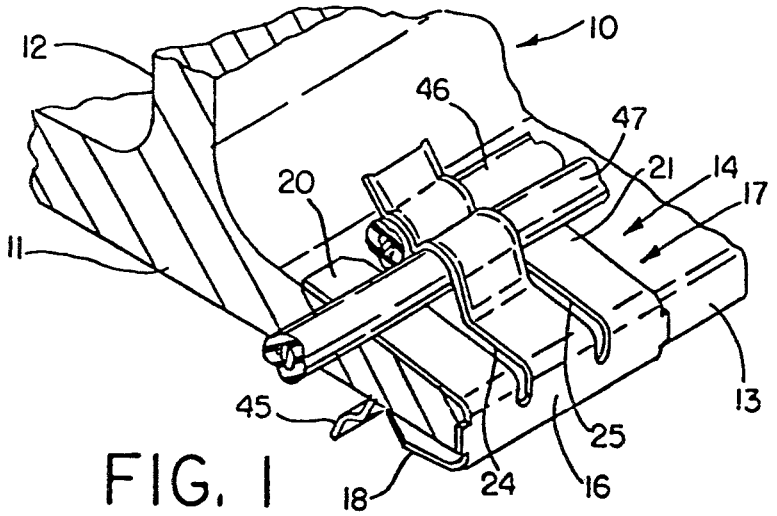
FIG. 1 is a fragmentary isometric of a rail with the clip of the invention installed and securing two conductors parallel to and within the rail base edge.
Figure 2:
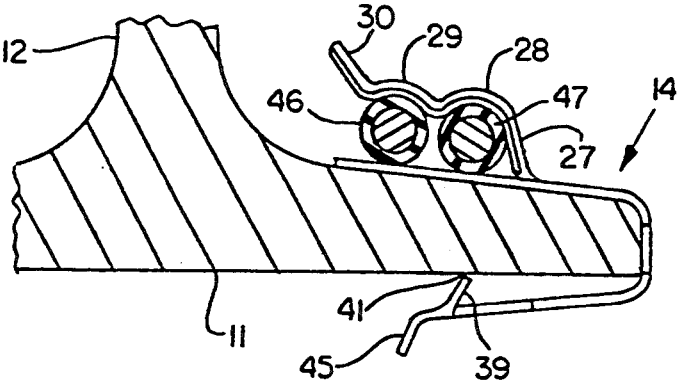
FIG. 2 is a fragmentary vertical section of the rail base showing the clip in elevation installed.

Referring first to FIGS. 1 and 2 there is illustrated a rail shown generally at 10. The rail includes a base 11, from the center of which projects web 12 supporting the enlarged head, not shown, on which the wheels roll. The base includes a longitudinal edge 13 on which the track circuit retainer clip 14 of the present invention is driven.

The retainer clip is formed of spring metal and is of a generally U-shape configuration including a bight portion 16, an upper leg 17, and a lower leg 18. The upper leg is actually two laterally spaced legs seen at 20 and 21 which are separated by a center spring finger 22. The center spring finger is separated from the two lateral portions of the upper leg by slots 24 and 25 which extend to the center of the bight portion 16. The center spring finger is coextensive with the two upper leg portions until it deflects upwardly as indicated at 27, such upward deflection being spaced substantially from the bight portion of the clip. The spring finger 22 is then formed into two side-by-side downwardly opening concave portions 28 and 29 and terminates in an upwardly angled tip 30. As indicated more clearly in FIGS. 4 and 5, the lateral edges of the spring finger are turned upwardly at an angle as seen at 32 and 33 from the deflection 27 to the tip 30.

The two upper leg portions 20 and 21 of the clip have their interior corners relieved as seen at 35 and 36 and the upturned edges 32 and 33 avoid sharp corners or edges between the upper portions of the clip and the spring finger.

Figure 4:
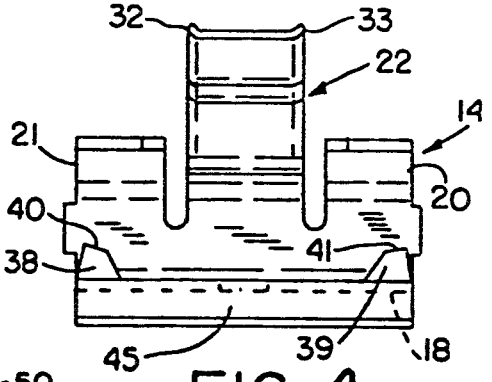
FIG. 4 is an elevation from the open end of the clip on the left hand side of FIG. 3.
Figure 5:
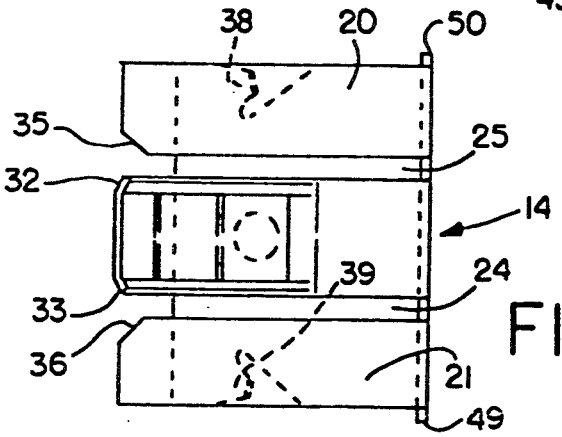
FIG. 5 is a top plan view of the clip.

The lower leg 18 of the clip has inwardly struck barbs 38 and 39 formed from the edge of the clip, such barbs extending at an inclined angle toward the bight portion 16. Such barbs each have a truncated linear biting edge as seen at 40 and 41, respectively, such edges extending generally parallel to the rail edge. As seen in FIG. 4 in the unstressed condition of the clip the biting linear edges 40 and 41 extend outwardly and upwardly at a slight angle to horizontal. When the clip is driven on the rail edge the stressed condition of the clip will bring the biting edges into parallelism with the bottom of the rail base. The linear biting edges illustrated facilite the driving on of the clip which may be accomplished with a hammer without marring or notching the rail and provide line biting contact extending longitudinally of the rail which produces improved holding power.

Figure 3:
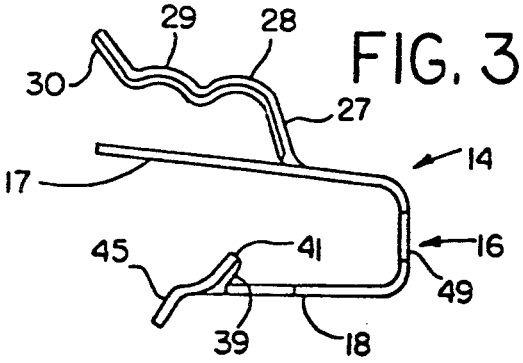
FIG. 3 is an elevation of the clip before installation.

The distal edge of the lower leg extends downwardly at an angle as seen at 45 to facilitate the installation of the clip on the edge of the rail base. As seen in FIGS. 2 and 3, once the clip is installed the clip is designed to support up to two insulated cables shown at 46 and 47 extending parallel to the rail and well within the edge 13 of the rail base. Once the clip is installed the cables may easily be inserted beneath the yielding center finger by passing the cables beneath the upturned outer edge 30.

The clip is also provided with two laterally extending short projections seen at 49 and 50 at the bight portion to facilitate removal of the clip if desired.

Since the finger is struck from the center of the bight portion, it provides the degree of flexure necessary to enable the cables readily to be inserted beneath the finger to be clamped between the upper leg portions and the finger while firmly holding the cables once in place. In this manner loose cables extending beyond the rail base edge are avoided. Because of the truncated biting edges of the barbs extending longitudinally of the rail base, the clip may readily be driven on the rail base edge without scratching or damaging the rail and when driven on is firmly secured in place.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A track circuit retainer clip for securing a conductor to a rail comprising a U-shape spring metal clip having a bight portion and upper and lower legs, said lower leg including tangs having truncated biting edges providing biting line contact extending longitudinally of the rail, said upper leg including an upwardly projecting spring finger adapted to receive at least one electrical conductor between said spring finger and the upper leg to secure the conductor parallel to and within the edge of the base of the rail, said bight portion being unobstructed whereby the clip may be driven on the edge of the rail base by the swing of a hammer.

2. A clip as set forth in claim 1 wherein said spring finger extends from the center of the clip and is positioned between two spaced portions of the upper leg.

3. A clip as set forth in claim 1 wherein said spring finger extends from said bight portion of the clip.

4. A clip as set forth in claim 1 wherein said spring finger includes a distal tip projecting away from the upper leg to facilitate the insertion of a conductor between said finger and upper leg.

5. A clip as set forth in claim 1 wherein said spring finger includes a concave recess to embrace an outer portion of the circumference of a conductor as it presses the conductor against the upper leg.

6. A clip as set forth in claim 1 wherein said spring finger includes two concave recesses to embrace the outer portions of side-by-side conductors as it presses the conductors against the upper leg.

7. A clip as set forth in claim 1 wherein said spring finger includes lateral edges bent away from the upper leg.

8. A clip as set forth in claim 1 wherein said tangs are struck from the edge of the lower leg.

9. A clip as set forth in claim 1 wherein said lower leg includes a downwardly flaring tip to facilitate the driving of the clip onto the rail base edge.

* * * * *